US006598261B2

(12) United States Patent
Howard

(10) Patent No.: US 6,598,261 B2
(45) Date of Patent: Jul. 29, 2003

(54) PRINTING PROCESS WEB CLEANER

(76) Inventor: Paul C. Howard, 10006 Karmont Ave., South Gate, CA (US) 90280

( * ) Notice: Subject to any disclaimer, the term of this patent is extended or adjusted under 35 U.S.C. 154(b) by 0 days.

(21) Appl. No.: 09/944,459

(22) Filed: Sep. 4, 2001

(65) Prior Publication Data

US 2003/0046787 A1 Mar. 13, 2003

(51) Int. Cl.[7] ..... A47L 5/38
(52) U.S. Cl. ..... 15/308; 15/309.1
(58) Field of Search ..... 15/308, 309.1

(56) References Cited

U.S. PATENT DOCUMENTS 3,751,756 A * 8/1973 Arnett, Jr. ..... 15/309.1
4,281,431 A * 8/1981 Nierlich et al. ..... 15/309.1
5,737,796 A * 4/1998 Sendzimir et al. ..... 15/308
5,836,044 A * 11/1998 Sinnett et al. ..... 15/309.1
6,162,303 A * 12/2000 Wieloch et al. ..... 134/15
6,178,589 B1 * 1/2001 Kaim ..... 15/308
6,193,810 B1 * 2/2001 Baum ..... 15/309.1
6,195,527 B1 * 2/2001 Ziegelmuller et al. ..... 399/352
6,207,227 B1 * 3/2001 Russo et al. ..... 427/208.6
6,259,882 B1 * 7/2001 Lindblad et al. ..... 399/352

* cited by examiner

*Primary Examiner*—Theresa T. Snider
(74) *Attorney, Agent, or Firm*—Albert O. Cota

(57) ABSTRACT

A web cleaner (20) is presented that removes debris that clings to the surface of a substrate in a printing process. The cleaner uses a number of idlers (26) holding a web (22) taut therebetween with the web driven at high speeds by a printing press (24). The cleaner utilizes a pair of counter rotating textured rollers (28) positioned between the idlers with one roller positioned on each side of the web in close proximity therewith and each roller rotates in an opposite direction to that of the webs flowpath. A air separating bar (36) is positioned at right angles to the web bordering each roller in adjacent relationship for directing the air into a plenum (44) that covers each roller and skiving bar. The plenum is used to collect the debris detached from the web surface by air currents formed by rotation of the rollers creating an air film on the web surface. The same air currents produce a positive air pressure within the plenum. A dust collector (50) is connected to each plenum for accumulating debris dislodged from the web surface.

17 Claims, 4 Drawing Sheets

PRINTING PROCESS WEB CLEANER

TECHNICAL FIELD

The present invention relates to web cleaners in general and more specifically, to a treatment system that lifts debris from the surface of a web of substrate material without touching either of its upper and lower surfaces.

BACKGROUND ART

Previously, many types of web cleaners have been used to provide an effective means for removing unwanted particles from the surface of a web in the printing discipline. A number of approaches have been used with limited or little success. Bristles, in the form of a brush rotating at a speed of 600 to 800 rpm, have been employed to lightly brush the surface of the web. Compressed air has been somewhat successful, however it was found that almost 2 pounds per square inch of pressure was required, which required considerable energy and had other complications. The combination of a rotating brush and vacuum was considered to be a viable solution, however it was also complicated and required vacuum blowers at high volume and brushes that contacted the surface of the web.

A search of the prior art did not disclose any patents that possess the novelty of the instant invention, however the following U.S. patents are considered related:

| U.S. Pat. No. | Inventor | Issue Date |
|---|---|---|
| 6,162,303 | Wieloch et al. | Dec. 19, 2000 |
| 6,178,589 | Kaim | Jan. 30, 2001 |
| 6,193,810 | Baum | Feb. 27, 2001 |
| 6,195,527 | Ziegelmuller et al. | Feb. 27, 2001 |
| 6,207,227 | Russo et al. | Mar. 27, 2001 |
| 6,259,882 | Lindblad et al. | Jul. 19, 2001 |

Wieloch, et al. in U.S. Pat. No. 6,162,303 teaches a process for cleaning a web having surfaces on opposite sides of the web with a cleaner roller against a major surface in one direction while the transport of the web remains uninterrupted and rolling the contact cleaner roll against the major surface in an opposite direction while the transport of the web is uninterrupted.

U.S. Pat. No. 6,178,589 issued to Kaim is for a track assembly that permits a pair of cleaning devices to operate on either side of a paper web moving upward through the floor of a press. The track assembly facilitates mounting and rapid removal of web cleaning buffs from beneath a press.

Baum in U.S. Pat. No. 6,193,810 discloses a method of cleaning tissue webs in a in rewinder utilizing the Coanda effect with a thin layer of air that scrubs off dust and lint imbedded and entangled in the web surface while stabilizing the web in its travel.

Ziegelmuller, et al. in U.S. Pat. No. 6,195,527 teaches a web cleaning device with a nesting structure that supports a coil of web fabric. A lip member forms a part of the nesting structure and a pay out end of the coil is wrapped around the lip member with a take up spindle spaced from the coil.

U.S. Pat. No. 6,207,227 issued to Russo; et al. presents a cleaning sheet with tacky surface coating that cleans feed rollers U.S. Pat. No. 6,259,882 of Lindblad, et al is for removing electrostatically charged particles from a surface of an image bearing belt.

DISCLOSURE OF THE INVENTION

In the printing discipline which includes lithographic offset printing, flexographic printing, gravure printing, letterpress printing and the like, blanket piling is a source of wasted time and lost production due to the necessity of frequent blanket washes. Lint, paper fibers and coating on the surface of the substrate can cause halftone plugging and so called "hickeys", which requires removal and washing of the blanket. Frequent blanket washes shorten the blanket's life and place unnecessary wear and premature deterioration of the printing press.

In view of the above disclosure, it is the primary object of the invention to completely clean the surface of the web prior to entering a print unit, which considerably reduces blanket washing. It has been found that the invention can increase the number of impressions run before a blanket wash is required.

An important object of the invention is directed to condition high speed webs by penetrating the surface barrier of the web without actual contact. The invention produces an air flow that directs air currents in a turbulent washing film over the web surface, thus completely removing slitter dust, loose clay coating and other debris. The invention is designed to be completely functional with almost any substrate used in printing, without damage to its surface such as paper, mylar and plastic.

Another object of the invention is to apply the use of air currents that are produced by a roller with a textured surface. The roller creates a narrow, pressurized area immediately at an extremely close space existing between the roller and the web, which, due to such a limited sector develops immense energy to the web that dislodges debris and moves loose particles without touching the web. The roller may have any textured surface that will cause air movement above its surface, however it has been found by extensive testing that a roller similar in design to a jewelry polishing wheel which is constructed of soft cotton buffing material, has proven optimum. Once the contaminants are lifted from the surface of the web they may be easily directed to a separate device that receives and stores the debris. The roller works best when the roller's surface speed is at least 20 percent greater than the surface speed of the web.

Still another object of the invention is that the rollers rotate in the opposite direction as the moving web this feature permits the air currents that surround the rotating roller to be easily directed into a plenum, which includes a air separating bar that separates the air containing particles that have been removed from the web from the roller and directs the airflow into the plenum and on into a dust collector under negative pressure.

Yet another object of the invention is that by having a clean web, print quality is enhanced and a consistent color is obtained. The conditioned web, as provided by the inventive web cleaner, reduces contamination in not only the ink train and dampers but also specifically the blankets of the printing equipment.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment which is shown in FIGS. 1 through 15, and that consists of a web cleaner 20 that is used for removing particles and other debris from the surface of a substrate web 22 used in a lithographic press 24. It should be noted that while the invention is specifically designed for use in conjunction with a lithographic press used for offset printing, other presses and printing equipment, or any other apparatus that utilizes a web requiring cleaning, may benefit equally well.

Figure 1:
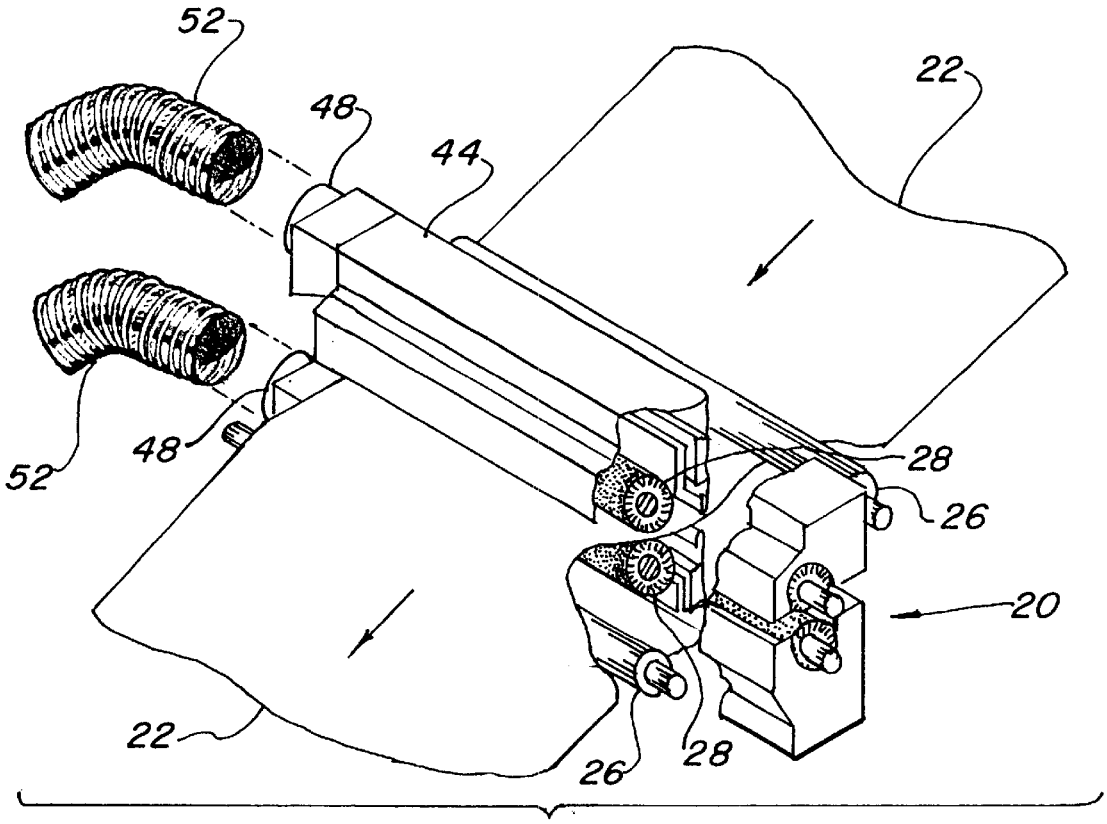
FIG. 1 is a partial isometric view of the preferred embodiment
Figure 2:
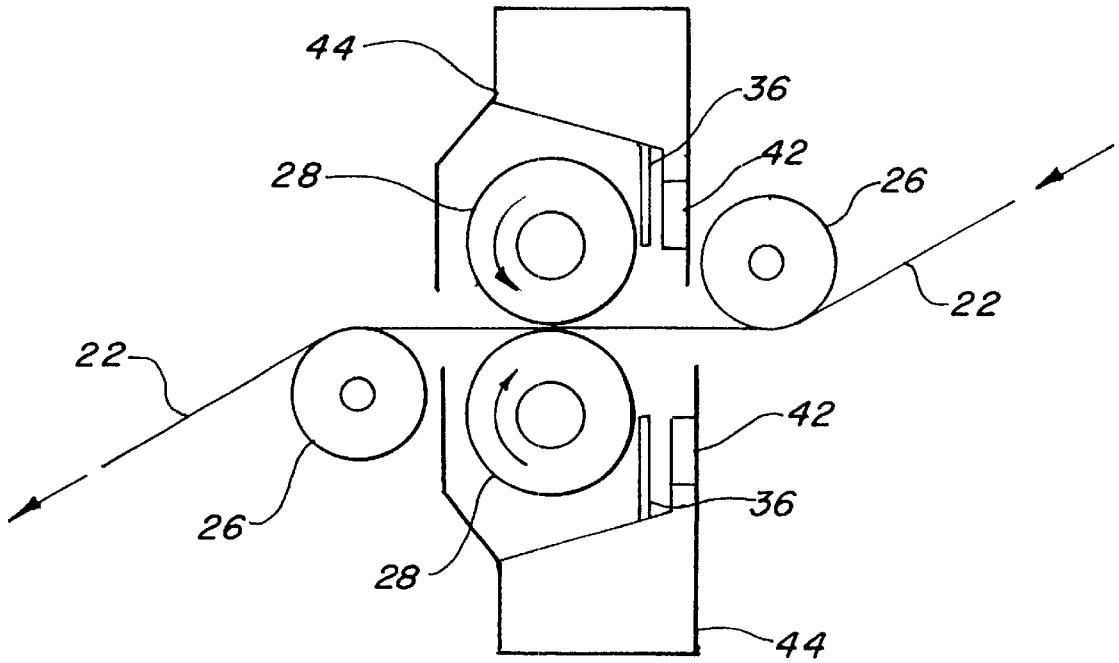
FIG. 2 is a schematic end view of the preferred embodiment with arrows indicating the rotation and flowpath of the web.
Figure 10:
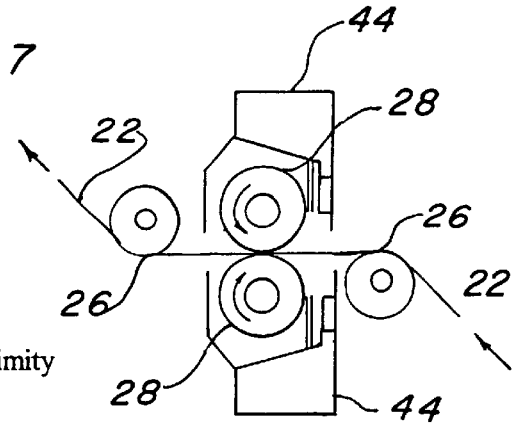
FIG. 10 is a partial schematic end view of the preferred embodiment with the web horizontal entering from the bottom.
Figure 9:
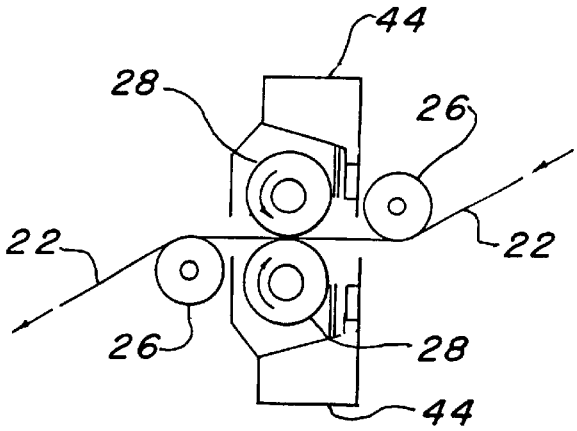
FIG. 9 is a partial schematic end view of the preferred embodiment with the web horizontal entering from the top.
Figure 11:
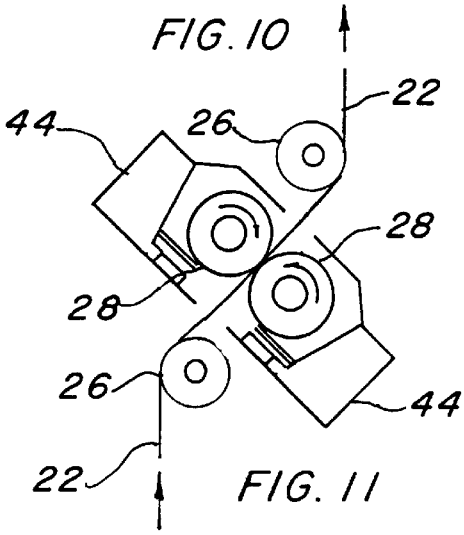
FIG. 11 is a partial schematic end view of the preferred embodiment with the web vertical entering from the top.
Figure 12:
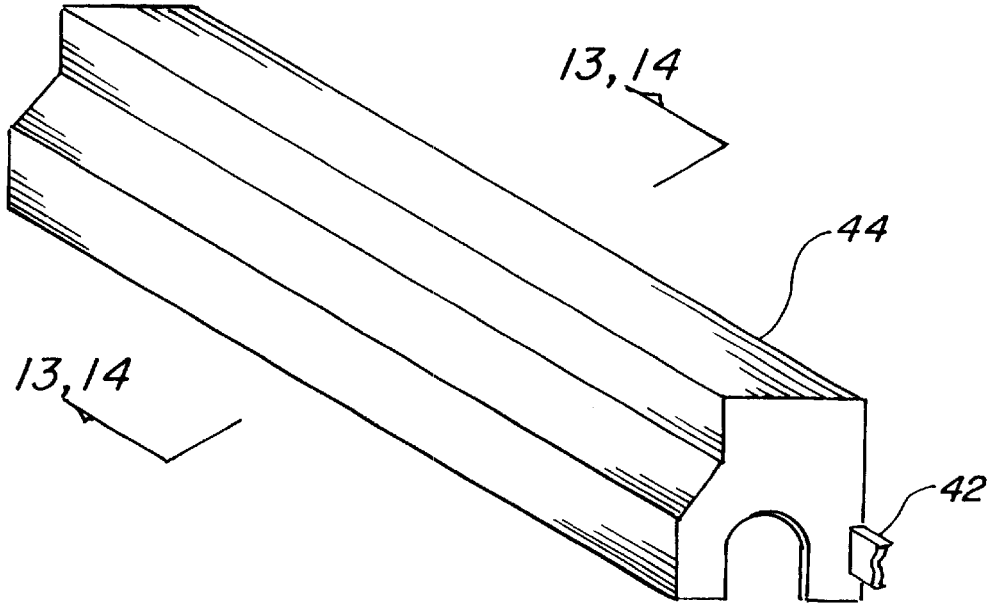
FIG. 12 is a partial schematic view of one of the plenum's shown by itself, removed from the invention for clarity.

A plurality of idlers 26, in the form of cylinders are employed in the invention, in which a web 22 of substrate material is held taut therebetween, as shown pictorially in FIGS. 1 and 2. The location of the idlers 26 and their relative position is determined by the configuration of the printing press and may vary randomly to accommodate a particular application. The web 22 is driven at high speeds by the printing press 24. FIGS. 9–11 illustrate a few combinations depending on where the web 22 enters and departs, such as from the top or bottom or straight through horizontally. The web cleaner 20 may also be angled to correspond with the flowpath of the web 22, as shown in FIG. 11. The use of the idler 26 is in common practice in the industry today and its construction is well known.

The web substrate material may be of any type used for printing or other industrial applications where a clean surface is required. The most common material consists of paper, mylar or thermoplastic film.

A pair of counter rotating, textured rollers 28 are positioned between the idlers 26, as illustrated in FIGS. 1–3 and 7–11, with one roller 28 unchangeably fixed on each side of the web 22 in close proximity therewith. The fact that the rollers 28 are fixed in their relative position between each other and the web 22 is a distinct advantage and contributes to the novelty of the invention in that it is unnecessary to continually adjust the span of the rollers as is the case with other approaches in the cleaning industry. Through experimentation it has been proven that the close proximity of the rollers 28 from 0.001 inch (0.0254 mm) to 0.010 inch (0.254 mm) on each side of the web 22 functions ideally.

Further, each roller 28 rotates in an opposite direction to that of the web's 22 flowpath and the roller works best when its surface speed is at least twenty percent greater than the surface speed of the web 22. This high speed creates sufficient turbulence in the area surrounding the periphery of the roller 28, thus, producing air currents that flow radially away from the roller 28. This phenomenon is used to clean the surface of the web 22, by using the natural air movement to its best advantage by impinging evenly on the entire length of the web surface between the rollers without any other source of compressed air.

The pair of counter rotating rollers 28 each have a peripheral speed at least double the speed of the moving web 22, which places the highest pressure at the appropriate focused position simultaneously on both the top and bottom surface of the web 22.

Figure 4:
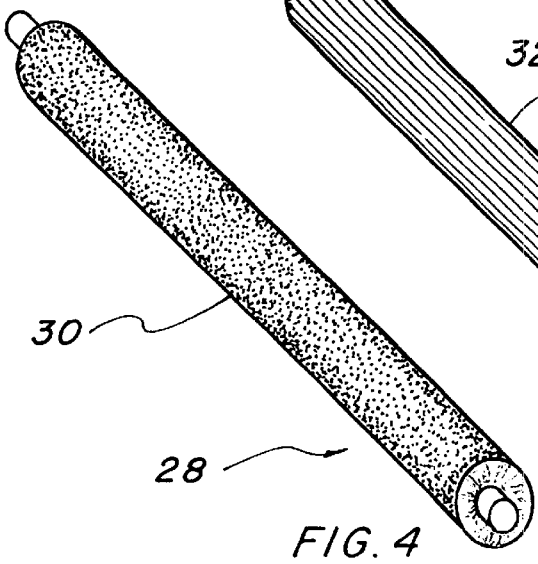
FIG. 4 is a partial isometric view of one of the textured rollers having a fabric-tufted buffing material surrounding the outside surface, illustrated by itself removed from the invention for clarity.
Figure 5:
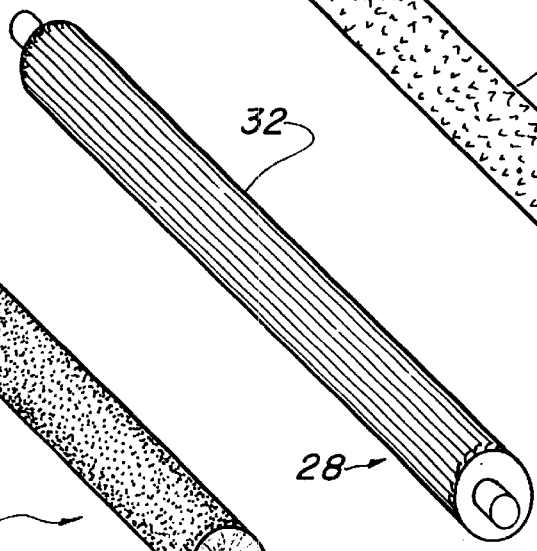
FIG. 5 is a partial isometric view of one of the textured rollers having a number of resilient blades on the outer surface, shown completely removed from the invention for clarity.
Figure 6:
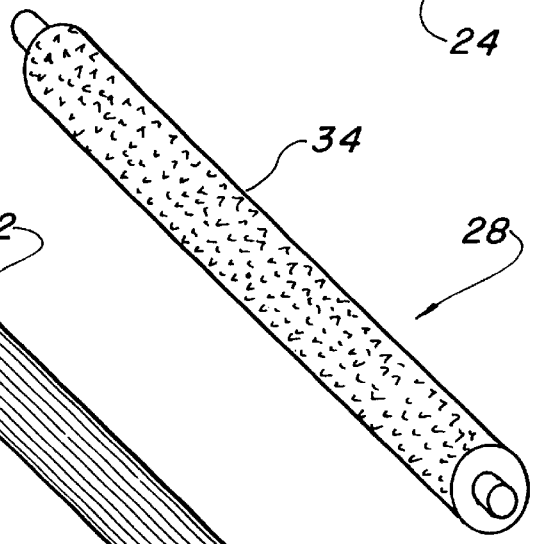
FIG. 6 is a partial isometric view of one of the textured rollers having an irregular surface on the roller, with the roller completely removed from the invention for clarity.

Each counter rotating textured roller 28 preferably has fabric-tufted buffing material 30 surrounding the outside surface, which is capable of creating of air currents. While the above material has been selected as having the optimum characteristics, other surfaces may also be used such as resilient blades 32 or a continuous irregular surface 34 on its outer periphery of sufficient variance to create the necessary film of air currents. The irregular surface 34 could be any type of superficies such as raised scoops, fingers, flaps, bumps or even a matrix of grooves or the like. However, an advantage of the fabric tufted buffing wheel material 30 is that when rotating it is safe for the an operator to work around, as there is nothing on its rotating surface that could injure a person even if touched when turning at full speed. It should be noted that the fabric tufted buffing material 30 is illustrated in FIG. 4, the resilient blades 32 in FIG. 5, and the irregular surface 34 in FIG. 6.

Figure 7:
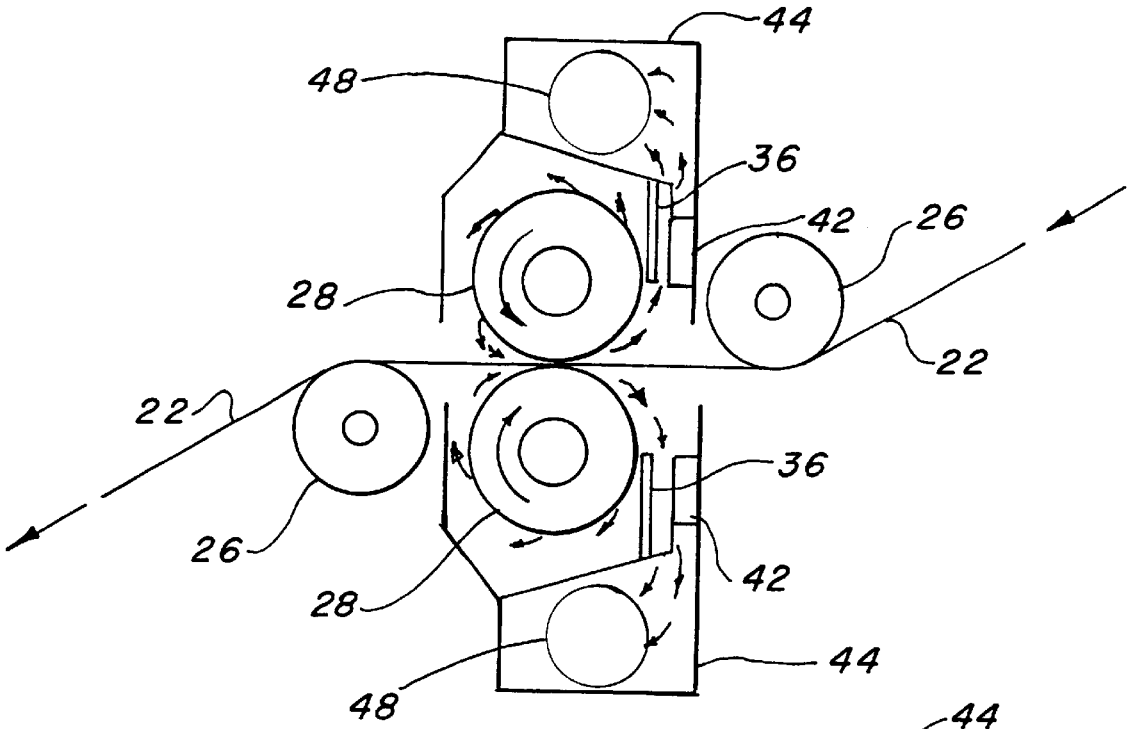
FIG. 7 is a schematic end view of the preferred embodiment with the air flow currents shown with directional arrows.
Figure 8:
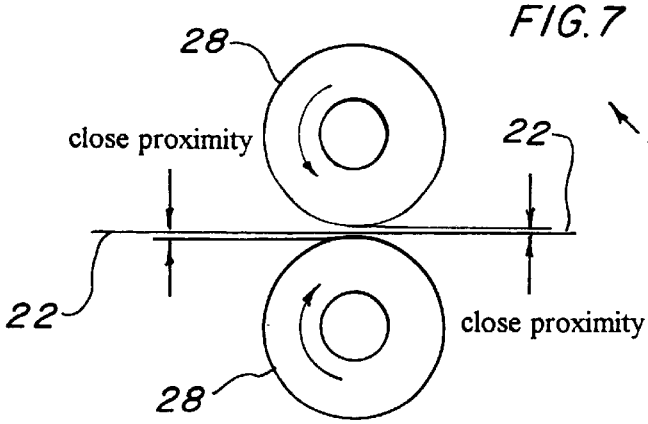
FIG. 8 is a schematic end view of the rollers and their proximity relationship with the web.

A air separating bar 36 is positioned on an upstream side at an angle between 90 degrees to 180 degrees to the web 22 bordering each roller 28 in immediate adjacent relationship therewith as shown in FIGS. 2 and 7. The purpose of each air separating bar 36 is to direct the particle laden air away from the web 22 in the direction of rotation of the roller 28. As illustrated the air separating bar 36 has a length at least that of the roller 28 and includes a blunt edge 38, shown in FIG. 13, or it can optionally have a sharp edge 40 as illustrated in FIG. 14. A structural support bar 42 is positioned opposite the air separating bar 36 for support of the cleaner 20 and to provide a frame for attachment of the idlers 26, rollers 28 and rotating equipment which is comprised of electric motors and drives, which are not shown, as they are well known in the art and in common usage today.

To cover and provide an area for accumulation of the debris laden air, a plenum 44 encloses each roller 28 and air separating bar 36 for collecting debris removed from the web surface by air currents formed by rotation of the rollers creating an air film on the web surface. The plenum 44 is shown by itself in FIGS. 12–15 and in its relationship with the other elements in FIGS. 1, 2, 7 and 19–11. The plenum 44 is preferably formed from sheet metal stock, blanked and pierced in the flat and broken to the desired shape by sheet metal equipment The appropriate roller 28 produces positive air pressure within the plenum 44 and provides a collecting area for the debris within the air.

Figure 13:
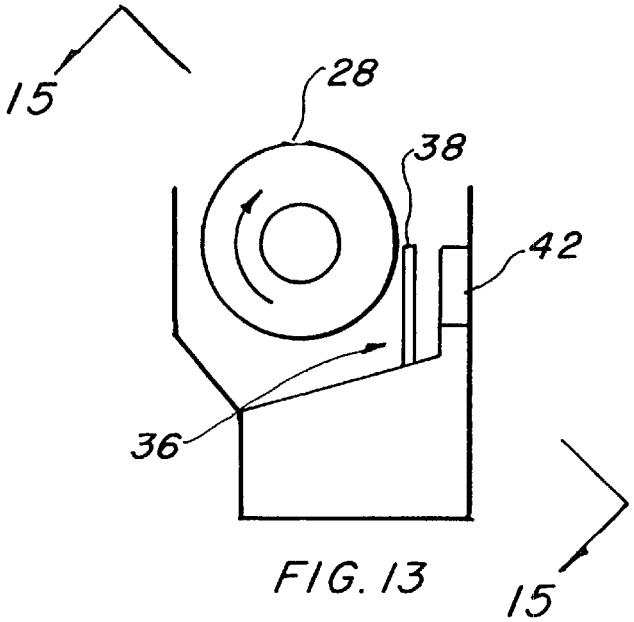
FIG. 13 is a cross sectional view taken along lines 13—13 of FIG. 12 illustrating the blunt air separating bar.
Figure 14:
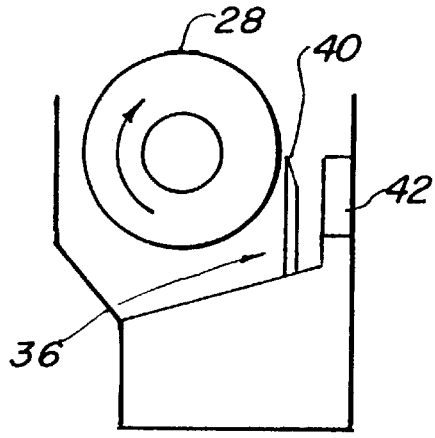
FIG. 14 is a cross sectional view taken along lines 14—14 of FIG. 12 illustrating the knife edge air separating bar.
Figure 15:
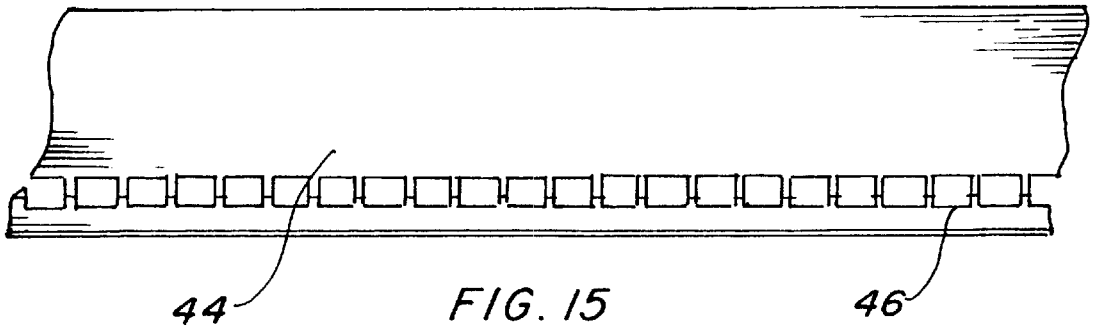
FIG. 15 is a cross sectional view taken along lines 15—15 of FIG. 13 illustrating the rectangular openings in the plenum.

Each plenum 44 contains a plurality of rectangular openings 46 that are adjacent to a distal end of the air separating bar 36, thereby permitting air to flow into the interior of the plenum 44, as shown in FIGS. 13 and 14. The air flow path taken from the periphery of the roller 28 through the plenum 44 is shown in FIG. 7. Each plenum 44 contains an outlet opening 48 on its top, center or end for passing the air from the plenum.

Each plenum 44 contains a plurality of rectangular openings 46 that are adjacent to a distal end of the air separating bar 36, thereby permitting air to flow into the interior of the plenum 44, as shown in FIGS. 13 and 14. The air flow path taken from the periphery of the roller 28 through the plenum 44 is shown in FIG. 7. Each plenum 44 contains an outlet opening 48 on its top, center or end for passing the air from the plenum.

Figure 3:
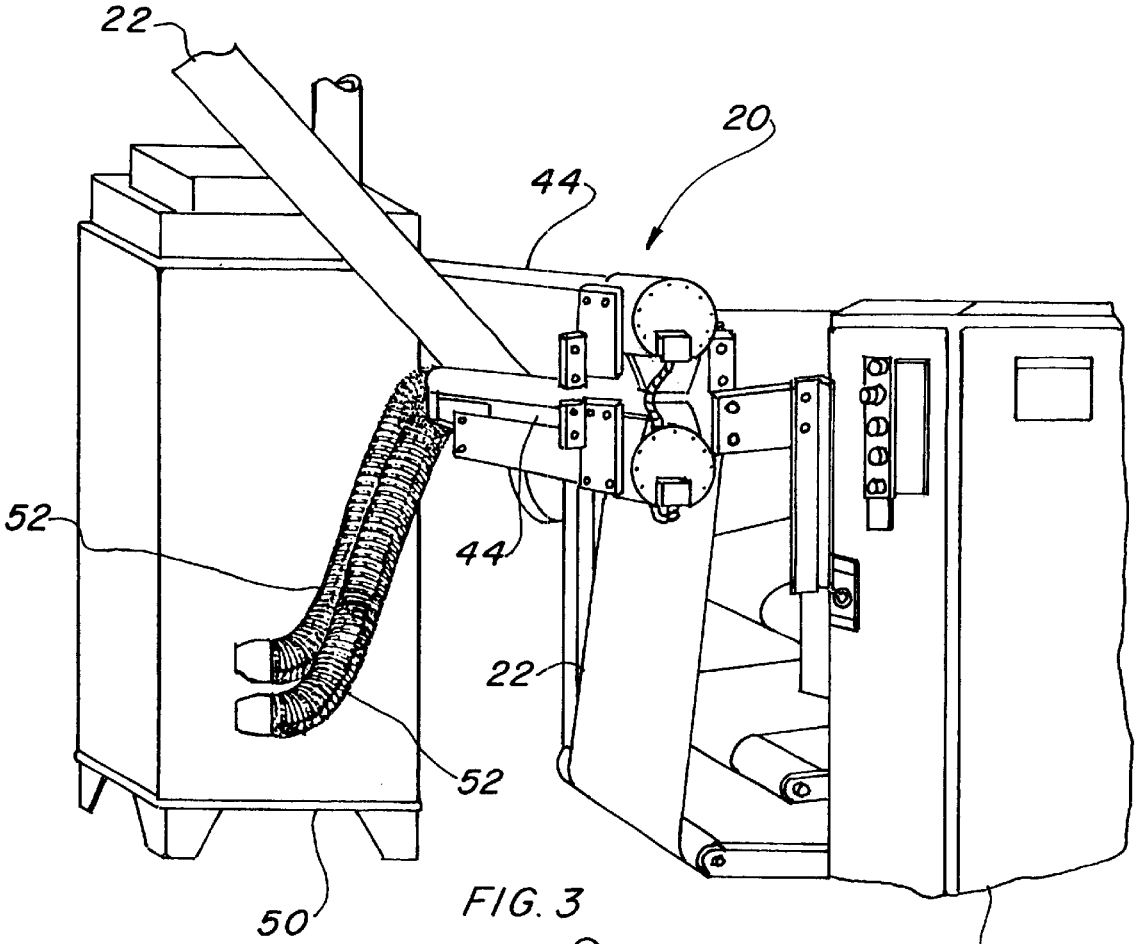
FIG. 3 is a partial isometric view of the preferred embodiment installed on a lithographic printing press.

In order to dispose of the debris from the surface of the web 22, a dust collector 50 is connected to each plenum 44, which ultimately accumulates the debris dislodged from the web surface. The connection from the plenum 44 to the dust collector 50 is provided by a flexible hose 52, as shown in FIG. 3. It should be noted that the dust collector 50 and hoses 52 are conventional and well known and other similar components may easily replace there utility.

The actual arrangement of elements are subject to change, due to the configuration of each printing press and the space available. The figures depict only a conceptual arrangement, mostly in outline schematic form, as the principles remain the same regardless of their orientation with each other.

While the invention has been described in complete detail and pictorially shown in the accompanying drawings, it is not to be limited to such details, since many changes and modifications may be made to the invention without departing from the spirit and scope thereof Hence, the web cleaner is described to cover any and all modifications and forms, which may come within the language and scope of the appended claims.

What is claimed is:

1. A web cleaner for removing particles and other debris that have a propensity to cling to the surface of a substrate used in a lithographic press, or the like, comprising;

a) a plurality of idlers defined as cylinders and a web of substrate material held taut between the idlers, wherein said web is driven at high speeds by a printing press, b) a pair of counter rotating textured rollers positioned between the idlers with one roller unchangeably fixed on each side of the web in close proximity therewith, each roller rotating in an opposite direction to that of the web's direction of travel or the like, c) a plurality of air separating bar positioned at an angle between 90 degrees to 180 degrees to the web with one bar in immediate adjacent relationship each roller in immediate adjacent relationship therewith, d) a plenum enclosing each roller and air separating bar for collecting debris detached from the web surface by air currents formed by rotation of the rollers, which creates an air film on the web surface and also the rotation of the rollers creates a positive air pressure within each plenum, and e) means for receiving and storing debris connected to each plenum for accumulating debris removed from the web surface.

2. The web cleaner as recited in claim 1 wherein said substrate material is selected from a group consisting of paper, mylar and thermoplastic film.

3. The web cleaner as recited in claim 1 wherein said pair of counter rotating textured rollers each have a fabric-tufted buffing material on their outside surface irregular enough to create a film of air currents.

4. The web cleaner as recited in claim 1 wherein said pair of counter rotating textured rollers each have a plurality of resilient blades on their outside surface irregular enough to create a film of air currents.

5. The web cleaner as recited in claim 1 wherein said pair of counter rotating textured rollers each have an irregular surface on their outer periphery irregular sufficiently in variance to create a film of air currents.

6. The web cleaner as recited in claim 1 wherein said pair of counter rotating textured rollers are capable of having a peripheral speed at least 20 percent greater than the surface speed of the driven web.

7. The web cleaner as recited in claim 1 wherein said pair of counter rotating rollers close proximity is from 0.001 inch (0.0254 mm) to 0.010 inch (0.254 mm) on each side of the web.

8. The web cleaner as recited in claim 1 wherein said air separating bar is disposed on an upstream side of the web relative to the rollers.

9. The web cleaner as recited in claim 1 wherein said air separating bar further comprises a blunt edge on the bar at an angle between 90 degrees to 180 degrees to the web.

10. The web cleaner as recited in claim 1 wherein said air separating bar further comprises a sharp edge on the bar located at an angle between 90 degrees to 180 degrees to the web.

11. The web cleaner as recited in claim 1 wherein each air separating bar is at least the full length of its corresponding roller.

12. The web cleaner as recited in claim 1 wherein each plenum contains a plurality of openings adjacent to the air separating bar, thus permitting air to flow into the plenum interior.

13. The web cleaner as recited in claim 1 wherein each plenum contains an outlet opening for connection to said means for receiving and storing debris.

14. The web cleaner as recited in claim 1 wherein said means for receiving and storing debris is comprised of a dust collector.

15. The web cleaner as recited in claim 1 further comprising a flexible hose between the plenum and the dust collector.

16. A web cleaner for removing particles and other debris that have a propensity to cling to the surface of a substrate used in a printing process, comprising;

a plurality of idlers having a web of substrate material driven by a printing press and held taut therebetween;

a pair of counter rotating textured rollers positioned in-between the idlers, with one roller fixed on each side of the web in close proximity therewith, each roller rotating in an opposite direction to that of the web's direction of travel, a air separating bar tangent to each roller in immediate adjacent relationship therewith, and a plenum enclosing each roller and air separating bar for collecting debris detached from the web surface by air currents that are formed by rotation of the rollers, which creates an air film an the web surface and also the rotation of the rollers creates positive air pressure within each plenum.

17. A web cleaner for removing particles and other debris that cling to the surface of a substrate used in a lithographic press, or the like, with a web of the substrate disposed between a plurality of idlers and held taut therebetween, comprising;

a pair of textured roller positioned in-between the idlers, with one roller immediately adjacent to each side of the web, each roller rotating in an opposite direction to that of the web's direction of travel, a air separating bar tangent to each roller in immediate adjacent relationship therewith, and a plenum enclosing each roller and air separating bar for collecting debris detached from the web surface by air currents formed by rotation of the rollers which creates an air film on the web surface and the rotation of the rollers creates a positive air pressure within each plenum.

* * * * *

UNITED STATES PATENT AND TRADEMARK OFFICE

CERTIFICATE OF CORRECTION

PATENT NO. : 6,598,261 B2
DATED : July 29, 2003
INVENTOR(S) : Paul C. Howard

It is certified that error appears in the above-identified patent and that said Letters Patent is hereby corrected as shown below:

Title page,
Item [76], revise to read:
-- [76] Inventor: Paul C. Howard, deceased, late of South Gate, CA (US), by Dianna A. Howard, legal representative --.

Column 5,
Line 60, "or the like" has been deleted;
Line 61, "plurality" has been replaced with -- pair --;
Line 61, "bar" has been replaced with -- bars --;
Line 63, -- to -- has been inserted after "relationship";
Lines 63-64, "in immediate adjacent relationship therewith" has been deleted;
Line 67, -- air currents -- has been inserted after "which".

Column 6,
Line 1, "creates" has been replaced with -- create --;
Lines 1-2, "and also the rotation of the roller creates" has been deleted.
Line 12, "irregular enough" has been replaced with -- which is capable of --;
Lines 12-13, "to create a film of" has been replaced with -- creating the --.
Line 16, "irregular enough to" has been replaced with -- which are capable of --;
Line 17, "create a film of" has been replaced with -- creating the --.
Lines 20-21, "irregular insufficiently in variance to create a film of" has been replaced with -- which is capable of creating the --;
Line 31, "bar is" has been replaced with -- bars are --.
Line 34, "bar further comprises" has been replaced with -- bars further comprise --;
Lines 34 and 37, "on the bar" has been deleted.
Line 37, "sharp" has been replaced with -- pointed --;
Line 66, "a" has been replaced with -- an --.

Column 7,
Line 4, "creates" has been replaced with -- create --;
Lines 4-5, "also the rotation of the rollers creates" has been deleted.

UNITED STATES PATENT AND TRADEMARK OFFICE

CERTIFICATE OF CORRECTION

PATENT NO. : 6,598,261 B2
DATED : July 29, 2003
INVENTOR(S) : Paul C. Howard

It is certified that error appears in the above-identified patent and that said Letters Patent is hereby corrected as shown below:

Column 8,
Line 3, "a" has been replaced with -- an --;
Line 8, "creates" has been replaced with -- create --;
Lines 9-10, "the rotation of the rollers creates" has been deleted.

Signed and Sealed this

Sixteenth Day of September, 2003

JAMES E. ROGAN
*Director of the United States Patent and Trademark Office*